US005093756A

United States Patent [19]

Kim

[11] Patent Number: 5,093,756

[45] Date of Patent: Mar. 3, 1992

[54] SEQUENTIAL-DELAYED POWER SUPPLYING CIRCUIT

[75] Inventor: Hyuk Kim, Suwon, Rep. of Korea

[73] Assignee: SamSung Electronics Co., Ltd., Suwon, Rep. of Korea

[21] Appl. No.: 378,917

[22] Filed: Jul. 12, 1989

[30] Foreign Application Priority Data

Oct. 31, 1988 [KR] Rep. of Korea ..... 88-18043

[51] Int. Cl.[5] ..... H01H 47/00

[52] U.S. Cl. ..... 361/195; 307/131; 361/194

[58] Field of Search ..... 361/170, 185, 186, 187, 361/194, 195; 307/112, 125, 126, 130, 131

[56] References Cited

U.S. PATENT DOCUMENTS 3,835,401 9/1974 Tomita et al. ..... 307/237
4,542,451 9/1985 Hucker ..... 323/222
4,642,726 2/1987 Matsko et al. ..... 361/195
4,716,490 12/1987 Alexanian ..... 361/195
4,933,798 6/1990 Widmayer et al. ..... 361/18

*Primary Examiner*—A. D. Pellinen
*Assistant Examiner*—Jeffrey A. Gaffin
*Attorney, Agent, or Firm*—Robert E. Bushnell

[57] ABSTRACT

The invention provides a sequential delayed power supplying circuit having the steps of driving the relay RY1 through a relay-driving part after delaying by the time-delay circuit the output of a rectifying part which rectifies the output of a direct current winding of a compound insulated transformer, and supplying alternating current power sequentially to a compound insulated transformer of the second set. Stabilizing the operation of the circuit may be possible, and connecting and driving an infinite number sets may be attained according to the present invention.

9 Claims, 2 Drawing Sheets

SEQUENTIAL-DELAYED POWER SUPPLYING CIRCUIT

BACKGROUND OF THE INVENTION

The present invention relates to a sequential-delayed power supply circuit, and more particularly to a circuit which can supply the sequential-delayed power to a set consisting of multiple stages such as a multivision.

In the past, in order to delay and supply the power of a set consisting of the multi-stages a set is connected as shown in FIG. 1, but the time-delay circuit with resistors and condensors is formed as an input stage so that a resistor of high value and a condensor for high voltage are required; also each set is sequentially driven through relays so that the sets to be driven are limited.

That is, the alternating current (i.e., "AC") power supplied to a power plug P1 is transferred to the first and second sets 10 and 20. In the first set 10, after the AC power is rectified and smoothed through a bridge diode BD1 and a condensor C1, it is applied to a main power terminal. But, in the second set 20, the AC power is applied through a relay RY1, after it is, first, delayed by the time-delay circuit consisting of resistors R1, R2, and a condenser C1.

Thus, in the second set 20, the AC power can be rectified and smoothed through a bridge diode BD2 and a condensor C4 only when the relay RY1 is driven, and it is provided to a main power, Also, in the third set, that is, in SET 3 the AC power is applied through a relay RY2 after it is again delayed by the time-delay circuit consisting of resistors R3, R4, and a condensor C3, so the sequential-delayed power can be supplied by repeating the same.

But, in this conventional circuit, the time-delay circuit is formed at the AC input stage, so that the resistor of a high value and the capacitor for the high voltage are required. Also the set is driven through the relays RY1, RY2 so that the sets to be driven are limited, and a considerable load follows for the operation of many sets.

SUMMARY OF THE INVENTION

The present invention has been made in consideration of this and has for its object to provide a sequential-delayed power supply circuit, in which the sets can be infinitely connected, and the operation of the circuit is stable.

According to the present invention there is provided a sequential-delayed power supply process and circuit comprising the steps of driving the relay through a relay-driving part after delaying by the time-delay circuit the output of a rectifying part which rectifies the output of a direct current of a compound insulated transformer; and supplying the AC power sequentially to a compound insulated transformer of the second set.

DETAILED DESCRIPTION OF THE INVENTION

The present invention will be now described in more detail with reference to accompanying drawings.

Figure 1:
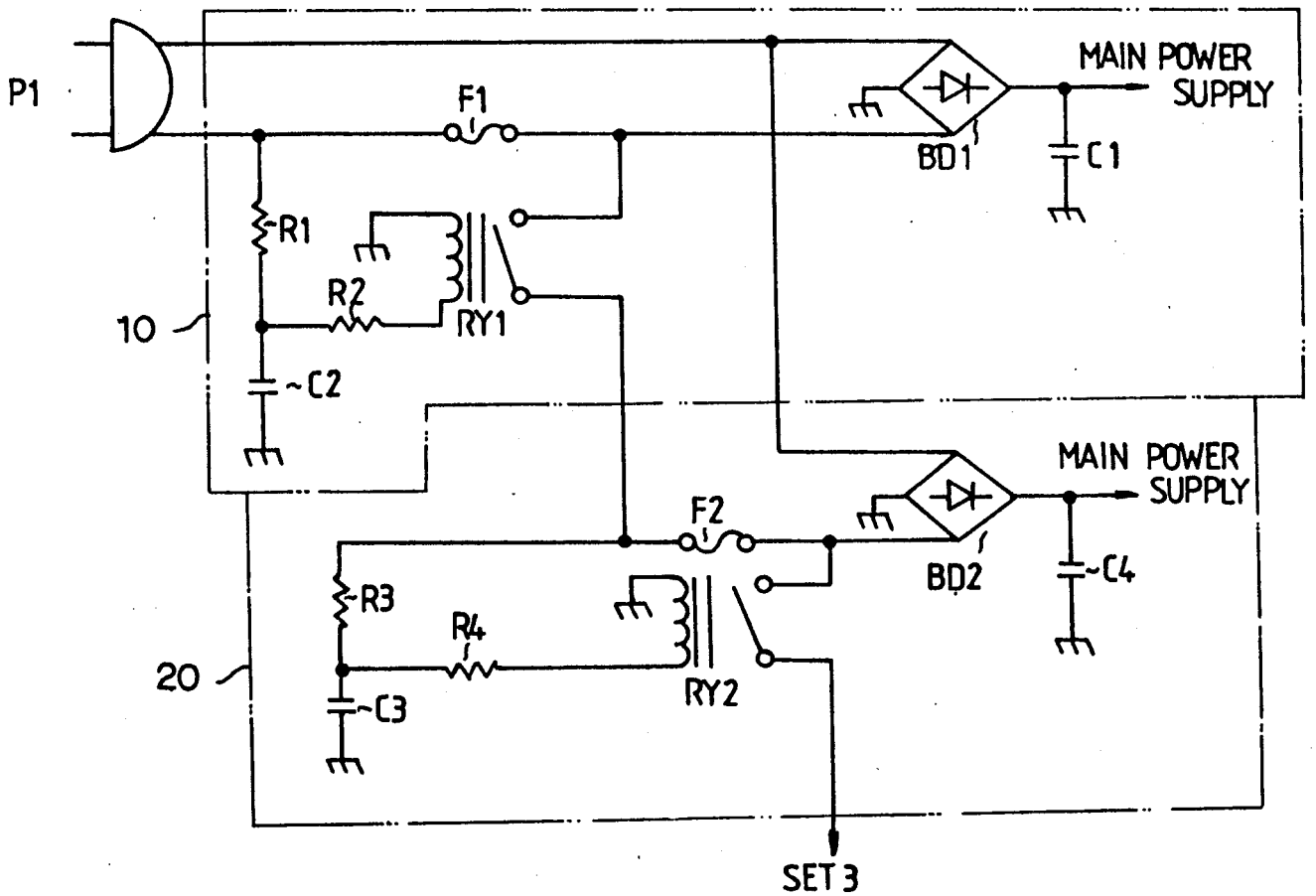
FIG. 1 is a conventional circuit diagram.
Figure 2:
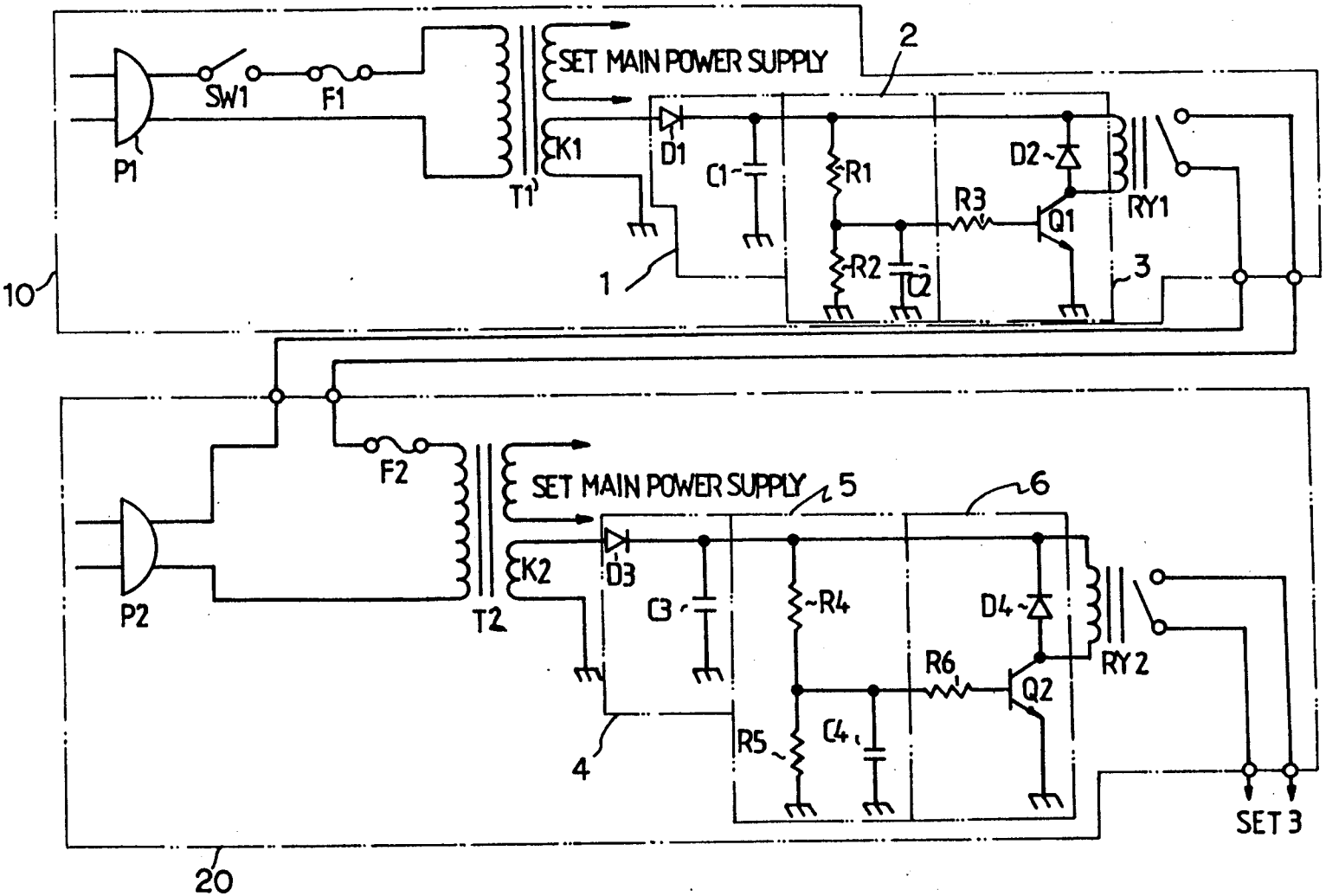
FIG. 2 is the circuit diagram of the present invention.

FIG. 2 shows an embodiment of the present invention. The AC power applied through a power plug P1 is provided to a compound insulated transformer T1 through an ON switch SW1 and a fuse F1 of the first set 10, thereby providing main power of the first set (i.e., the first appliance) to the secondary terminal of the compound insulated transformer T1 ad the output of the secondary direct current winding terminal K1 is half-wave rectifying by a rectifying part formed by diode D1 and condensor C1. The rectified output, the half-wave rectified output is delayed through the time-delay circuit formed by the resistors R1, R2, and the condensor C2 as much as a RC time-constant.

The power delayed by the time-delay circuit turns on transistor Q1 of the conventional relay-driving part 3, so that the AC power applied to a power plug P2 is provided to compounded insulated transformer T2 of the second set 20 through the relay RY1.

Also, the secondary output of the compound insulated transformer 2 in the second set (i.e., the second appliance) 20 drives a relay RY2 through the rectifying part 4, the time-delay circuit 5, and the relay-driving stage 6 as described in the first set 10.

The symbols D2, D4 and R3, R6 are relay-protecting diodes and currents limiting resistors, respectively.

A time-constant of the time-delay circuit 2 is given by R1/R2. A parallel resistance value of R1 ad R2 times a capacitance value of C2, and that of the time-delay circuit 5 is the same.

The present invention like this, will be described with an example of a color television. The present invention can be applied to multi-stages, but here, an example of the only two stages is to be described for convenience.

That is, although power plugs P1 and P2 of the first and second sets are inserted to an outlet, the AC power is not applied to both sets since the switch SW1 and the relay RY1 are OFF. To apply AC power to each set, the switch SW1 of the first set 10 is ON, then the AC power is applied to the compound insulated transformer T1 through switch SW1 and fuse F1.

Thus, the main power of the first set is provided through the secondary side of the transformer T1, and the power is induced at the direct current terminal of the transformer T1. (Where, the 'term direct current' means that the AC power of K1 terminal is converted into direct current later, by a rectifying circuit). At this time, the induced power to the K1 terminal is half-wave rectified by the rectifying stage 1 consisting of the diode D1 and the condensor C1, and it is applied to the time-delay circuit consisting of the resistors R1, R2, and the condensor C2.

The time-delay circuit 2 delays the applied power as much as the RC time-constant, that is (R1//R2. C2), and turns on the transistor Q1, thereby driving the relay RY1. Thus, if the relay RY1 is turned on, the AC power applied to the power plug P2 is the compound insulated transformer T2 of the second set 20 through the relay RY1 so that the main power of the second set is provided through the secondary terminal.

Similarly, the induced power of the direct current terminal K2 of the transformer T2 drives the relay RY2 through the rectifying stage 4, the time-delay circuit 5, and the relay driving part 6 so that the AC power is supplied to a third set (i.e., to Set 3, not shown in FIG. 2). That is, in order to supply sequentially the power of the set consisting of multi-stages such as a multivision, each of the power plugs P1 and P2 is inserted, and the switch SW1 of the first set becomes ON, then the main power is provided to the first set 10, thereby making the first set operate. At the same time, the induced power to the secondary direct current terminal K1 of the compounded insulated transformer T1 is rectified through the rectifying stage 1 and is delayed by the time-delay circuit 2, next, it drives the relay RY1 through the relay driving stage 3 so that the AC power is also provided to the second set.

Thus, the second set 20 begins to operate when the relay RY1 is driven. The second set 20 drives the relay RY2, by repeating the same operation as described before and provides the AC power to the third set (not shown). Thus, the power of multi-connected sets is sequentially delayed and supplied. Also, the present invention drives each circuit by using a low power induced to the secondary direct current terminal of the compound insulated transformer in order to provide the AC power. Thus, the operation of each set is stable, and the set can be infinitely connected since the power is sequentially provided.

As mentioned above, the present invention can obtain the effects that the operation of the circuit is stable and an infinite number of the sets can be connected and driven.

The invention is in no way limited to the embodiment described hereinabove. Various modifications of disclosed embodiment as well as other embodiments of the invention will become apparent to persons skilled in the art upon reference to the description of the invention. It is therefore contemplated that the appended claims will cover any such modifications or embodiments as fall within the true scope of the invention.

What is claimed is:

1. A sequential-delayed power supplying process, comprising the steps of:

providing a first alternating current power supply to a primary winding of a first compound insulated transformer;

providing, to a first set, a second alternating current power supply from a secondary winding of said first compound insulated transformer;

driving a relay in said first set through a relay-driving stage after delaying, by a time-delay circuit, an output of a rectifying stage rectifying a third alternating current power supply from said secondary winding of said first compound insulted transformer; and enabling a supplying of said first alternating current power sequentially to a primary winding of a second compound insulated transformer of a second set in response to said step of driving a relay.

2. A sequential-delayed power supply circuit, comprising:

first means for dividing power from an alternating current source into a first plurality of secondary alternating current potentials;

rectifying means for providing a rectified potential from a first one of said secondary alternating current potentials;

second means for dividing power from said alternating current source into a second plurality of secondary alternating current potentials;

means for responding to occurrence of a potential difference, by enabling application of the alternating current source to said second means for dividing power from the alternating current source; and means for delaying said occurrence.

3. The sequential-delayed power supply circuit of claim 2, wherein said first power dividing means comprises:

a transformer having a primary winding connectable across the alternating current source, a first secondary winding providing said first one of said secondary alternating current potentials and a second secondary winding providing a second one of said secondary alternating current potentials.

4. The sequential-delayed power supply circuit of claim 3, wherein said means for responding to occurrence of a potential difference comprises:

means coupled to said rectifying means, for, in response to said rectified potential, completing an electrically conducting path between the alternating current source and the second means for dividing power from the alternating current source; and means for, in response to said occurrence, conducting an electrical current flowing through said electrically conducting path completing means.

5. The sequential-delayed power supply circuit of claim 3, wherein said:

rectifying means comprises:

a diode coupled between a first node and a first output terminal of said first secondary winding; and a first capacitor coupled between said first node and a second output terminal of said first secondary winding;

and and means for responding to occurrence of said potential difference comprises:

a relay having a solenoid with one input lead coupled to said first node, and a set of contacts connectable in a current path between the alternating current source and the second means for dividing power from the alternating current source; and a transistor having principal electrical current conducting electrodes coupled between a second input lead of said solenoid and said second output terminal.

6. The sequential-delayed power supply circuit of claim 5, wherein said delaying means comprises:

first and second resistances coupled together across said first node and said second output terminal, to form a second node separated from said first node by said first resistance and connected to a control electrode of said transistor; and a second capacitance coupled between said second output terminal and said second node.

7. The sequential-delayed power supply circuit of claim 2, wherein said means for responding to occurrence of a potential difference comprises:

means coupled to said rectifying means, for, in response to said rectified potential, completing an electrically conducting path between the alternating current source and the second means for dividing power from the alternating current source; and means for, in response to said occurrence, conducing an electrical current flowing through said electrically conducting path completing means.

8. The sequential-delayed power supply circuit of claim 2, wherein said:

rectifying means comprises:

a diode coupled between a first node and a first output terminal of said first power dividing means; and a first capacitor coupled between said first node and a second output terminal of said first power dividing means;

and said means for responding to occurrence of said potential difference comprises:

a relay having a solenoid with one input lead coupled to said first node, and a set of contacts connectable in a current path between the alternating current source and the second means for dividing power from an alternating current source; and a transistor having principal electrical current conducting electrodes coupled between a second input lead of said solenoid and said second output terminal.

9. The sequential-delayed power supply circuit of claim 8, wherein said delaying means comprises:

first and second resistances coupled together across said first node and said second output terminal, to form a second node separated from said first node by said first resistance and connected to a control electrode of said transistor; and a second capacitance coupled between said second output terminal and said second node.

* * * * *

UNITED STATES PATENT AND TRADEMARK OFFICE

CERTIFICATE OF CORRECTION

PATENT NO. : 5,093,756

DATED : March 3, 1992

INVENTOR(S) : Hyuk Kim

It is certified that error appears in the above-indentified patent and that said Letters Patent is hereby corrected as shown below:

Column 1, Line 29, replace the comma with a period; (1st occurrence).
Column 2, Line 4, replace "Tl ad" with --Tl, and--;
Column 4, Line 28, replace "and" with --said--;
Column 4, Line 57, replace "conducing" with --conducting--.

Signed and Sealed this

Fifteenth Day of June, 1993

*Attest:*

Michael K. Kirk

MICHAEL K. KIRK

*Attesting Officer*

*Acting Commissioner of Patents and Trademarks*